US005716261A

United States Patent [19]

Watkin

[11] Patent Number: 5,716,261

[45] Date of Patent: Feb. 10, 1998

[54] OSCILLATING BLAST CLEANER

[75] Inventor: Robert B. Watkin, Peachtree City, Ga.

[73] Assignee: The Wheelabrator Corporation,, LaGrange, Ga.

[21] Appl. No.: 701,007

[22] Filed: Aug. 21, 1996

Related U.S. Application Data

[63] Continuation of Ser. No. 183,194, Jan. 14, 1994, abandoned.

[51] Int. Cl.[6] ..... B24C 3/06

[52] U.S. Cl. ..... 451/92; 451/75

[58] Field of Search ..... 451/90, 89, 88, 451/87, 75, 92

[56] References Cited

U.S. PATENT DOCUMENTS

| | | | |
|---|---|---|---|
| 1,342,488 | 6/1920 | Woods . | |
| 3,409,854 | 11/1968 | Swallert | 451/92 |
| 3,566,543 | 3/1971 | Fogle . | |
| 3,788,010 | 1/1974 | Goff . | |
| 3,863,393 | 2/1975 | Goff . | |
| 3,864,876 | 2/1975 | Deihn . | |
| 3,872,625 | 3/1975 | Fuma et al. . | |
| 3,900,968 | 8/1975 | Shigyo . | |
| 3,900,969 | 8/1975 | Diehn | 451/87 |
| 3,934,373 | 1/1976 | Leliaert et al. | 451/92 |
| 3,984,944 | 10/1976 | Maasberg et al. . | |
| 4,029,164 | 6/1977 | Urakami . | |
| 4,149,345 | 4/1979 | Atsuchi . | |
| 4,199,905 | 4/1980 | Neidigh et al. . | |
| 4,286,417 | 9/1981 | Shelton . | |
| 5,231,806 | 8/1993 | Swain | 451/92 |
| 5,240,503 | 8/1993 | Levy et al. | 451/92 |
| 5,285,601 | 2/1994 | Watkin et al. | 451/92 |
| 5,291,697 | 3/1994 | Nelson | 451/92 |

FOREIGN PATENT DOCUMENTS

| | | |
|---|---|---|
| 0384873 | 8/1990 | European Pat. Off. . |
| 2170430 | 9/1973 | France . |
| 2429838 | 1/1976 | Germany . |
| 632695 | 10/1982 | Switzerland . |
| 634491 | 2/1983 | Switzerland . |
| 891446 | 3/1962 | United Kingdom . |
| 1098839 | 1/1968 | United Kingdom . |
| 1256922 | 12/1971 | United Kingdom . |
| 1400058 | 7/1975 | United Kingdom . |
| 2040193 | 8/1990 | United Kingdom . |
| WO8100372 | 2/1981 | WIPO . |

*Primary Examiner*—James G. Smith
*Assistant Examiner*—Derris H. Banks
*Attorney, Agent, or Firm*—Rudnick & Wolfe

[57] ABSTRACT

The cleaning apparatus of the invention consists of a surface cleaning or treating unit such as a blast machine mounted on a support structure for oscillating motion relative thereto. In the preferred embodiment, the blast machine consists of a blast wheel for projecting abrasive onto the surface, a hopper for collecting the spent abrasive and debris, a screw conveyor for returning the spent abrasive and debris to a separator where the debris is separated from the abrasive and the abrasive is returned to the blast wheel. The support structure is supported against the surface being cleaned on sleds and is raised and lowered over the surface by a winch. The blast machine is simultaneously oscillated relative to the support structure in a direction perpendicular to the path of travel of the support structure by a fluid cylinder and cable arrangement. As a result, the blast machine is able to clean or otherwise treat a path from the bottom to top of the structure as wide as the range of oscillation. Finally, the components of the apparatus are designed to be removable such that the apparatus can be quickly and easily broken down to a size small enough to fit through small passages such as those found on storage tanks and the like.

9 Claims, 6 Drawing Sheets

OSCILLATING BLAST CLEANER

This application is a continuation of application Ser. No. 08/183,194 filed on Jan. 14, 1994 now abandoned.

BACKGROUND OF THE INVENTION

The invention relates, generally, to surface treating machines and, more particularly, to an improved blast machine for cleaning substantially vertical surfaces.

It is often necessary to clean or otherwise treat large substantially vertical surfaces such as ship hulls, large storage tanks and the like. Numerous efforts have been made in this area to design a machine that can be secured to these vertical surfaces in a manner that allows the machine to traverse the surface while cleaning or otherwise treating the surface. The problems inherent in supporting a large machine on a vertical surface, however, have caused these efforts to be mostly unsuccessful as these machines have been too large, cumbersome, expensive and inefficient to be commercially successful.

One problem associated with such devices is that the surfaces over which they must travel are not smooth, uniform surfaces. As will be appreciated, the surfaces of ship hulls and large storage tanks include projections and obstructions that prevent large machines from reaching corners, crevices and other hard to reach areas. Moreover, these projections may make it difficult for devices that rely on magnets or suction to adhere to the surface.

A second problem is encountered specifically with large storage tanks that are found at refineries, depots and other similar facilities and are used to store gasoline, oil and the like. It is necessary to periodically clean or otherwise treat the inside as well as the outside of these structures. Access to the interior of these structures, however, is limited to a substantially two foot diameter door. As a result, large machines, typically used to clean the exterior of these structures, cannot fit through the door such that the interior of the tanks must be cleaned by hand using a scaffold specifically designed for use in the interior of these tanks. As will be appreciated, the hand cleaning process is extremely slow and labor intensive and can be dangerous to those working on the inside of the tank.

Thus, an improved surface treating apparatus that can clean large vertical surfaces yet is compact enough to reach corners and crevices and the interior of structures such as storage tanks is desired.

SUMMARY OF THE INVENTION

The cleaning apparatus of the invention consists of a surface cleaning or treating unit such as a blast machine mounted on a support structure for oscillating motion relative thereto. In the preferred embodiment, the blast machine consists of a blast wheel for projecting abrasive onto the surface, a hopper for collecting the spent abrasive and debris, a screw conveyor for returning the spent abrasive and debris to a separator where the debris is separated from the abrasive and the abrasive is returned to the blast wheel. The support structure is supported against the surface being cleaned on sleds that slidably engage the surface and is raised and lowered over the surface by a winch. Permanent bar magnets prevent the blast machine from swinging relative to the surface being cleaned. The blast machine is simultaneously oscillated relative to the support structure in a direction perpendicular to the path of travel of the support structure by a fluid cylinder and cable arrangement. As a result, the blast machine is able to clean or otherwise treat a path from the bottom to top of the structure as wide as the range of oscillation. Finally, the components of the apparatus are designed to be removable such that the apparatus can be quickly and easily broken down to a size small enough to fit through small passages such as those found on storage tanks and the like.

DETAILED DESCRIPTION OF THE INVENTION

Figure 1:
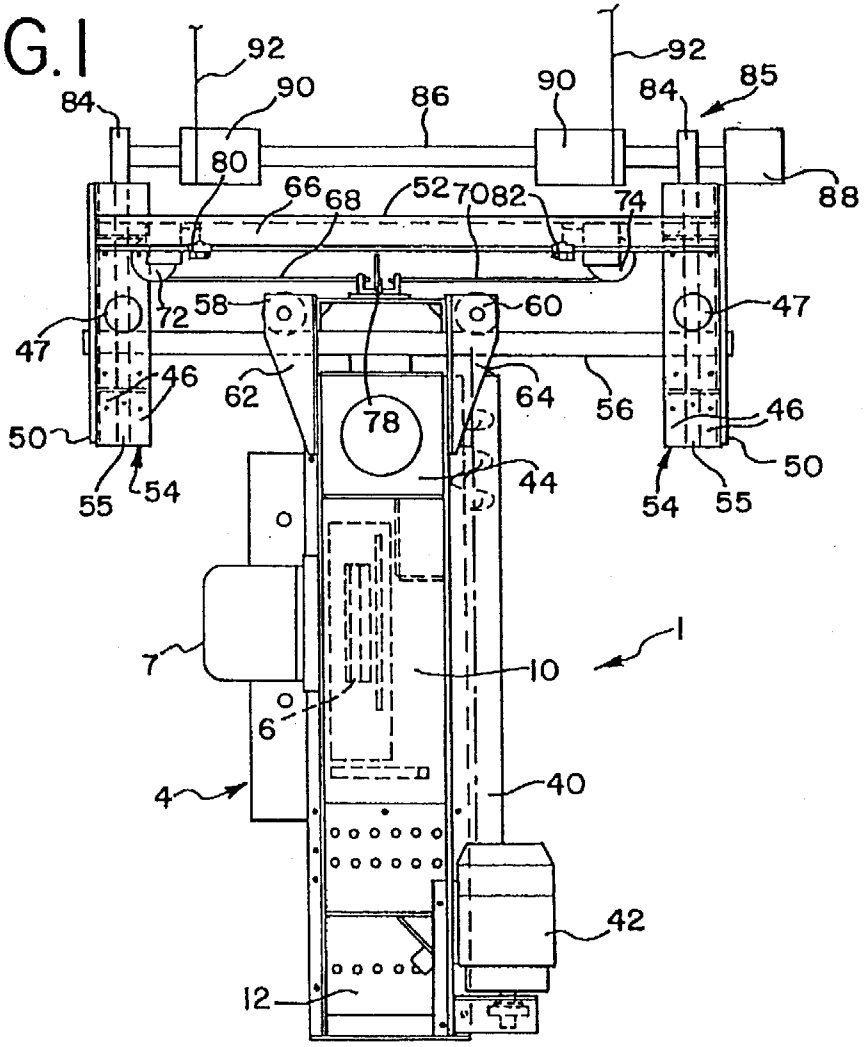
FIG. 1 is a front view of the preferred embodiment of the apparatus of the invention suspended on a vertical surface.
Figure 2:
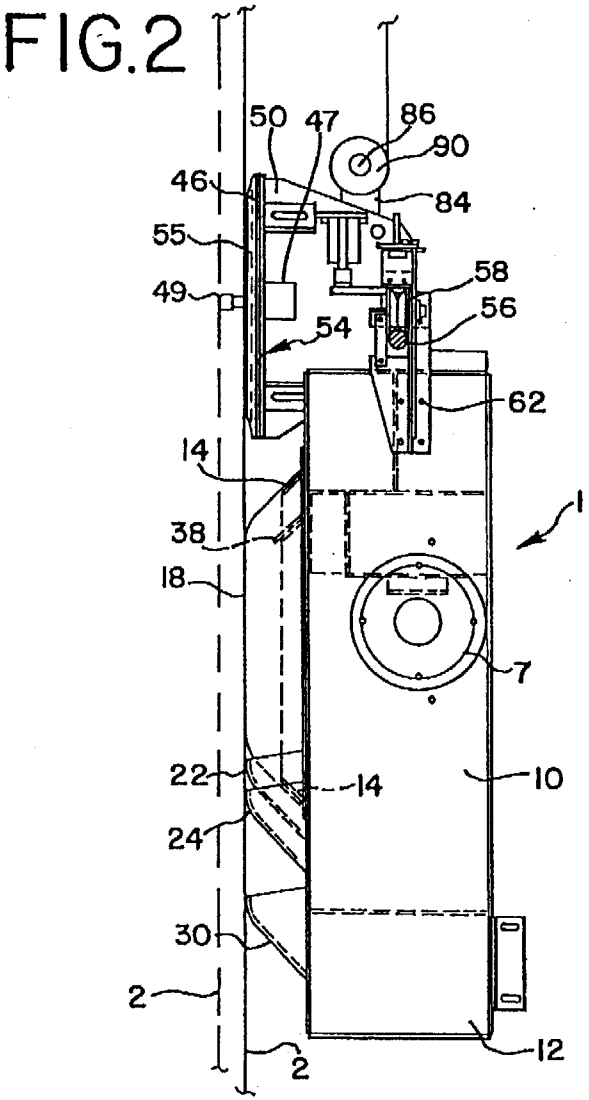
FIG. 2 is a side view of the apparatus of the invention suspended on a vertical surface.
Figure 6:
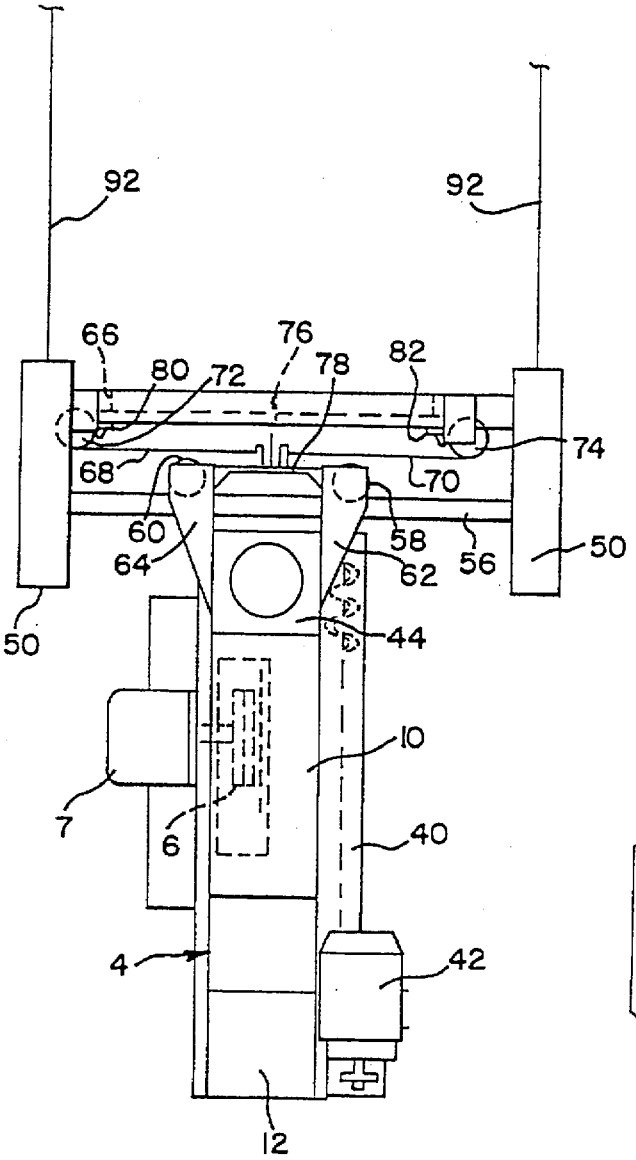
FIG. 6 is a front view of an alternate embodiment of the invention.

Referring more particularly to FIGS. 1 and 2, a preferred embodiment of the cleaning apparatus of the invention is shown generally at 1 suspended against a substantially vertical surface 2 such as a ship hull or storage tank. The cleaning apparatus 1 includes a blast unit 4 consisting of a blast wheel 6 for projecting abrasive against surface 2. Blast wheel 6 is rotated at high speed by electric motor 7 and projects the abrasive through a blast chamber formed in the blast machine housing 10 as will be understood by one skilled in the art.

A hopper 12 is mounted to the underside of housing 10 to collect the spent abrasive and debris after the abrasive impacts surface 2. As will be appreciated, the abrasive strikes the surface 2 with sufficient kinetic energy to cause it to rebound from the surface and into hopper 12.

Figure 3:
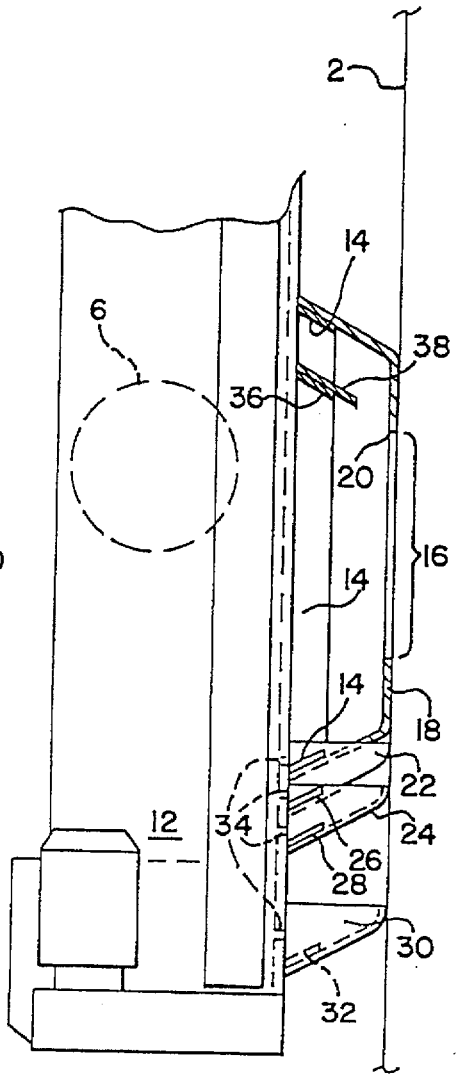
FIG. 3 is a detailed side view showing the sealing arrangement of the invention.

To prevent the escape of abrasive and debris from the blast zone a seal arrangement is provided as best shown in FIGS. 2 and 3. Specifically, four baffles 14 extend from housing 10 to define a rectangular chamber surrounding blast zone 16. A resilient seal 18 is mounted over baffles 14 which contacts surface 2 to prevent the escape of abrasive and debris. Seal 18 consists of a square of flexible material secured to the baffles 14 at its periphery and having an aperture 20 formed centrally therein. Seal 18 contacts the surface 2 with aperture 20 disposed over the blast zone 16 such that the abrasive thrown by wheel 6 can contact the surface but the spent abrasive and debris are prevented from escaping the blast zone.

A second flexible seal 22 and third flexible seal 24 are mounted to baffles 26 and 28, respectively, below and partially surrounding seal 18. Seals 22 and 24 trap abrasive that may escape seal 18. An additional flexible seal 30 is mounted on baffle 32 below seal 24 to collect any abrasive that may escape seals 22 and 24. Holes 34 are formed in the housing to communicate the areas enclosed by the seals to the hopper 12 such that the abrasive collected by seals 18, 22, 24 and 30 will drain into hopper 12. An additional baffle 36 and seal 38 are mounted inside of seal 18 above the blast zone to direct stray abrasive and debris downward toward holes 34.

Referring again to FIGS. 1 and 2, the blast unit further includes a screw conveyor 40 that is driven by motor 42. Screw conveyor 40 removes the spent abrasive and debris from the hopper 12 and delivers it to separator 44. Separator 44 can have any suitable construction that allows the abrasive to be separated from the debris and that delivers the abrasive back to wheel 6 as is known in the art.

A support structure or carriage 48 supports blast unit 4 on surface 2 and consists of a pair of side plates 50 connected by a cross member 52. Each side plate 50 is supported on a sled 54 that rides on and slides over surface 2. Each sled 54 includes a strip of high molecular weight plastic 55 that contacts and slides over surface 2. Located on either side of strip 55 are permanent magnets 46. Magnets 46 magnetically attract surface 2 to prevent the apparatus from swinging as it traverses the vertical surface.

When the apparatus reaches the end of its vertical path of travel, either at the top or bottom of surface 2, the apparatus is moved horizontally as will hereinafter be described. Before it is moved horizontally, however, the magnets 46 must be removed from magnetic engagement with surface 2. Accordingly, an air cylinder 47 is arranged on each sled 54 such that its reciprocating piston 49 extends perpendicularly to surface 2. When piston 49 is retracted the apparatus will be arranged with the surface 2 in the solid line position (FIG. 2) where sled 54 and seals 18, 22, 24 and 30 are in contact with the surface. In this position the blast cleaning operation is conducted. When plunger 49 is extended as shown in FIG. 2, the apparatus is moved away from surface 2 such that there is a gap between the apparatus and surface 2, shown in dashed line in FIG. 2. In this position, the apparatus can be moved horizontally without resistance from the magnetic attraction between magnets 46 and surface 2.

Also extending between side plates 50 is an elongated cylindrical rail 56. Rail 56 supports the blast unit in a suspended manner via pulley wheels 58 and 60 that are freely rotatable in yokes 62 and 64 which, in turn, are fixed to the blast unit 4. The pulley wheels 58 and 60 simply ride on rail 56 such that the blast unit 4 can be separated from support structure 48 merely by lifting wheels 58 and 60 from rail 56.

Mounted to cross member 52 is the drive system for oscillating the blast unit 4 relative to the support structure 48. The drive system consists of a fluid cylinder 66 fixed to cross member 52. Flexible transmission members or cables 68 and 70 are reeved around pulleys 72 and 74 and are connected at their one end to the opposite sides of the movable piston (not shown) of cylinder 66 and at their opposite ends to flange 78 that is fixed to blast unit 4 via yokes 62 and 64. As a result, when the piston of cylinder 66 is reciprocated by alternately pressurizing the chambers on opposite sides of the piston, the transmission members 68 and 70 will transmit the reciprocating motion to blast unit 4. Such cable/cylinder drives are commercially available.

When cylinder 66 is activated, the blast unit 4 will be oscillated left and right as viewed in FIG. 1 as the wheels 58 and 60 ride on rail 56. Switches 80 and 82 can be mounted on cross member 52 at any suitable position to be contacted by flange 78 thereby to control the pressurization of cylinder 62 and the width of the path traversed by the oscillating blast unit. While the cable/cylinder drive is shown, it is to be understood that other suitable oscillating drive mechanisms could be used if desired.

To raise and lower apparatus 1, a winch 85 is mounted to the top of the apparatus. Specifically, a pair of bearing blocks 84 rotatably support shaft 86. Shaft 86 is rotatably driven by variable speed reversible motor 88 and supports a pair of cable drums 90. Cables 92 have their first ends connected to and reaved around drums 90 and have their opposite ends secured to the top of the surface being cleaned by any suitable support mechanism as will hereinafter be described. By actuating motor 88, shaft 86 is rotated to wind and unwind cables 92 on cable drums 90 thereby to raise and lower the entire apparatus.

Figure 4:
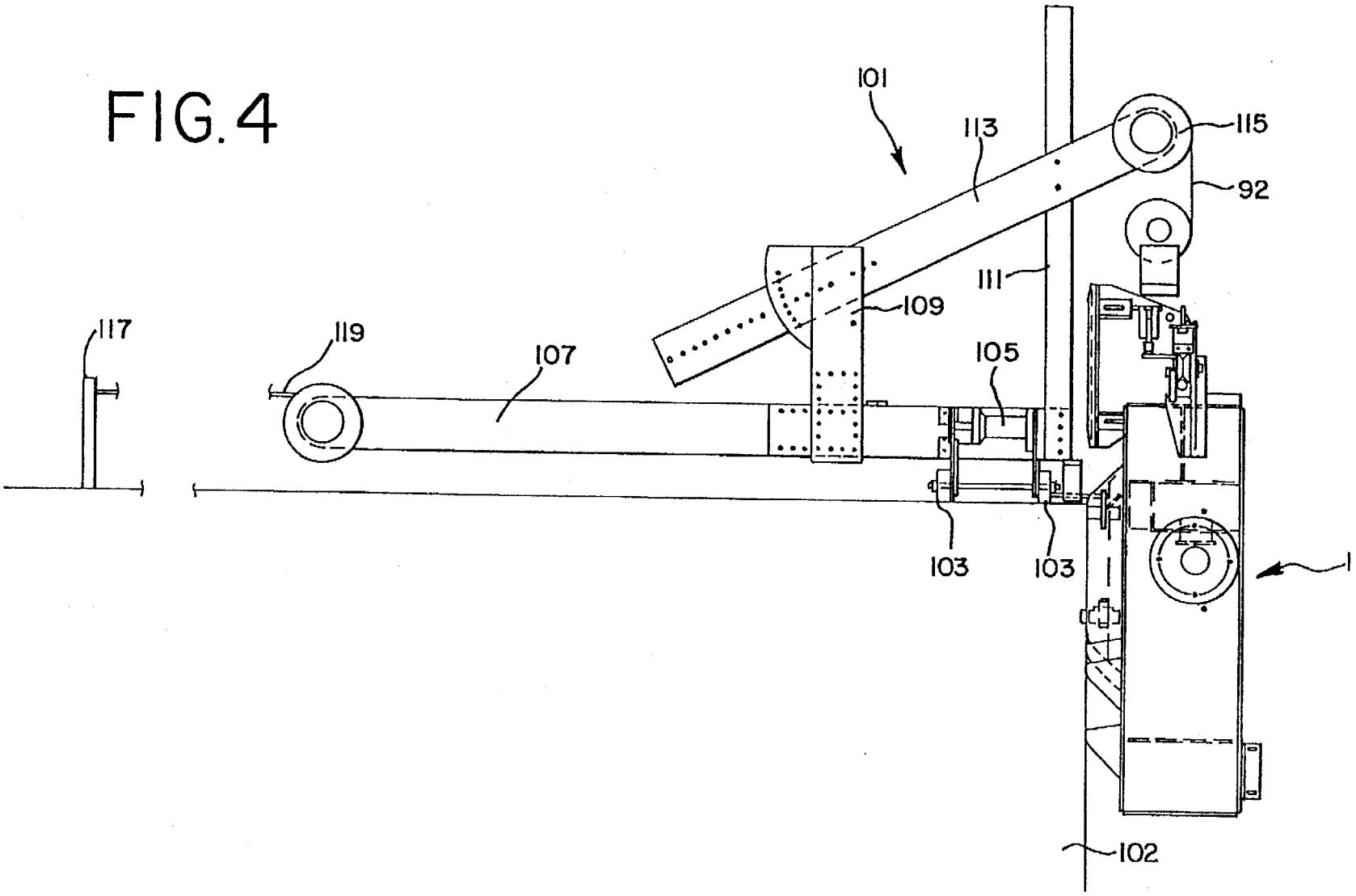
FIGS. 4 and 5 are side views, showing the system for supporting the apparatus of FIG. 1 on a vertical surface.
Figure 5:
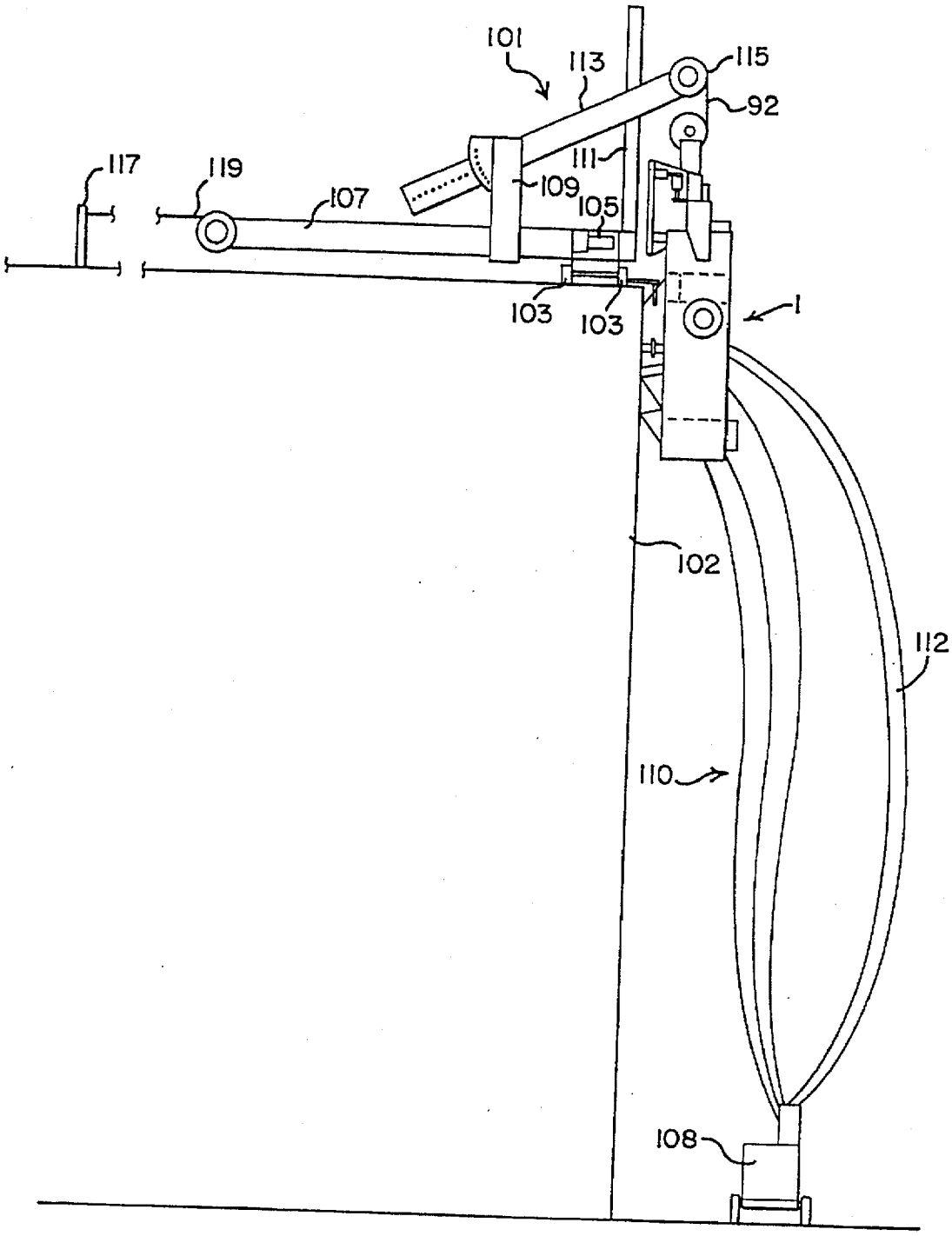

Referring to FIGS. 4 and 5, a preferred support structure is illustrated for supporting the apparatus on a storage tank. The support structure includes a relatively small fixture 101 located on the top of the tank 102. Fixture 101 includes four wheels 103 (two of which are shown) that ride on the top of tank 102. Wheels 103 are driven by a hydraulic motor 105 or other suitable drive mechanism. The wheels 103 carry a support structure consisting of a horizontal arm 107 supporting a first vertical support 109 and a second vertical support 111. A pair of support arms 113 are supported by vertical supports 109 and 111 (only one of which is visible in FIG. 4) and has their ends 115 extending over the edge of the vertical surface and connected to the ends of cables 92 thereby to support apparatus 1 on surface 2. The fixture 101 is dimensioned and constructed such that it counterbalances the weight of apparatus 1. The position of vertical support 109 and support arm 113 can be made adjustable to accommodate vertical tanks or other structures having different configurations. Moreover, for tanks having different constructions the arrangement of fixture 101 can be modified so long as it is capable of traversing the surface and counterbalancing or supporting the weight of apparatus 1.

The fixture 101 is supported on tank 102 by a tether arrangement. The typical storage tank includes a post 117 mounted in the center thereof. A cable 119 connects arm 107 to the post 117. Thus, when wheels 103 are driven by motor 105, support 101 will circle about the periphery of tank 102 on tether 119.

A cart 108 is positioned on the ground and carries the power and remote control system for controlling the fluid cylinder 66, motor 42, motor 88, motor 7 and motor 105. In the preferred embodiment, these drive mechanisms can be hydraulically operated where a compressor located on cart 108 drives all of the motors via hydraulic lines 110 or remotely controlled electric motors. It will be appreciated that other remote controlled drive systems can be used if desired.

Cart 108 can also carry a dust collector that is connected to separator 44 of apparatus 1 via hose 112. Hose 112 pulls air through separator 44 to separate the abrasive from the debris in an air wash system as will be appreciated by one skilled in the art.

Figure 7:
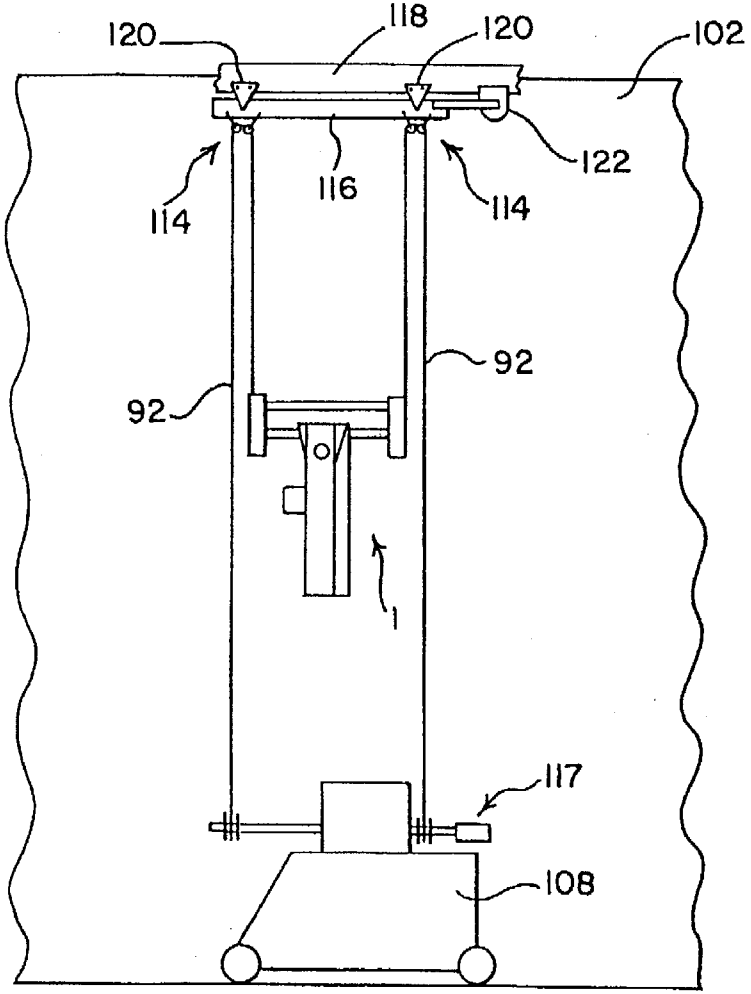

An alternate embodiment of apparatus 1 is illustrated in FIG. 7 where like numerals are used to identify like components of the preferred embodiment illustrated in FIG. 1. Eliminated from the embodiment of FIG. 7 is the winch such that cables 92 are connected directly to side plates 50. In this embodiment cables 92 are reaved around pulley wheel assemblies 114 supported on the top of ship hull or tank 102 on beam 116 as best shown in FIGS. 7 and 8.

The opposite ends of cables 92 are connected to a winch 117 that is supported on the movable cart 108. The cart 108 is weighted such that it is heavier than the apparatus 1 and can support the apparatus on the vertical surface 2. The winch 117 is driven to slowly wind and unwind the cables 92 thereby to raise and lower the entire apparatus 1 over the surface 2. The cart 108 also supports the controls for driving the various motors via hydraulic or electric lines as previously described with respect to FIGS. 4 and 5.

Figure 8:
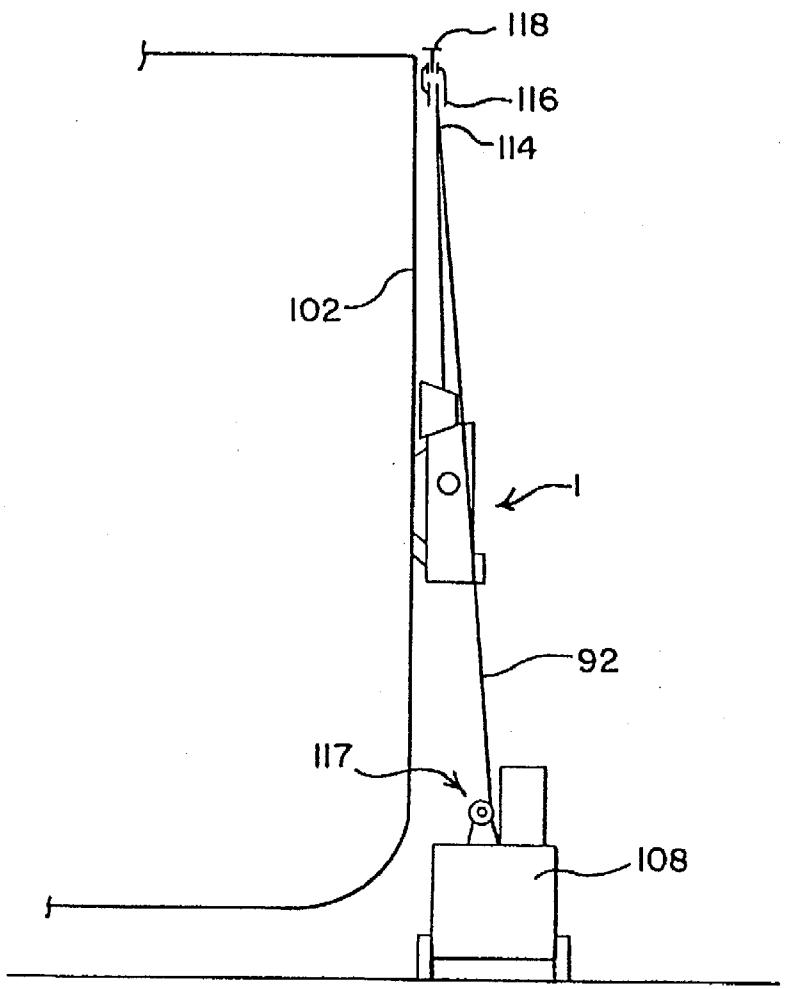
FIGS. 7 and 8 are front and side views, respectively, showing an alternate system for supporting the apparatus of the invention.

As shown in FIGS. 7 and 8 beam 116 is supported on a relatively larger beam 118 on wheel assemblies 120 such that beam 116 can reciprocate relative to beam 118 in a horizontal direction. Beam 118 is supported on the top of the surface 2 by any suitable means such as fixture 101 as described with reference to FIGS. 4 and 5 or a boom arm as will hereinafter be described with reference to FIGS. 9 through 12. A traction drive 122, also controllable from the ground, moves beam 116 relative to beam 118. As a result, the blast machine 1 can be moved laterally over surface 2 after each vertical pass of machine 1 by actuating drive 122.

While in the illustrated embodiment beam 116 is supported by beam 118, it is to be understood that beam 116 could be supported directly by fixture 101 (or other support mechanism) and beam 118 eliminated. With such a configuration beam 116 would be stationary and would be moved by support 101, boom arm or other support after each vertical pass of machine 1.

Another preferred support structure for the apparatus 1 will now be described with reference to FIGS. 9 through 12. Beam 116 is shown supported adjacent surface 2 by a boom 124 mounted on truck 126. While a boom is illustrated it will be appreciated that the apparatus 1 could be supported on a mobile hydraulic hoisting crane or "spider" where the operator is situated in a cage located at the end of the boom arm at the top of the surface being cleaned. Any structure that can suspend the apparatus i from a position above the surface being cleaned can be used. Because the apparatus 1 is raised and lowered by cables 92 which are mounted to beam 116, the beam 116 must be supported in a horizontal position regardless of the inclination of boom 124 in order to allow the machine to traverse the surface properly. When a JLG or spider is used as the support, the beam 116 is supported by the operator's cage and will be maintained in a horizontal orientation because the orientation of the cage is automatically maintained.

To maintain the horizontal orientation of beam 116 when a boom is used as the support, the support structure 128 is used. The support structure 128 includes a clamp 130 for fixing the support to the boom 124. The clamp 130 consists of two plates 132, 134 that surround the boom and are fixed together by fasteners such as bolts with the boom clamped therebetween. A pivot arm 138 is pivotally connected to plates 132, 134 by pin 140 such that arm 138 can pivot about a horizontal axis relative to boom 124.

The cable 142 of the boom arm is reaved around pulleys 144 at the end of boom 124 and is connected to arm 138. The winding and unwinding of cable 142 will cause arm 138 to pivot relative to boom 124. Thus, as the inclination of boom 124 changes, the arm 138 can be maintained in the illustrated horizontal position by winding or unwinding cable 142 as required.

Figure 9:
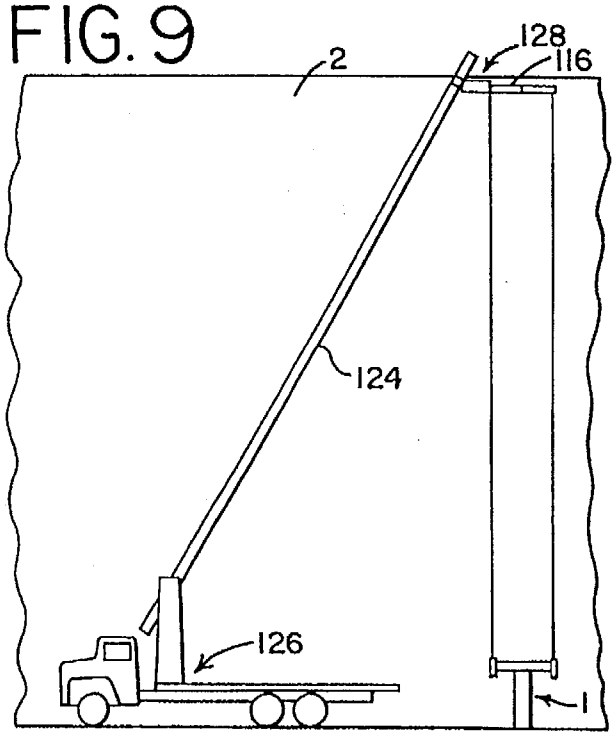
FIG. 9 is a front view showing the system supported on a vertical surface by a boom.

Arm 138 carries the beam 116 that supports the blast machine. While in the illustrated embodiment arm 138 is supporting beam 116, it will be appreciated that arm 138 could support beam 118 and beam 118 support beam 116 as described with reference to FIG. 7. In either case the beam is supported on pin 140 such that it can pivot about a vertical axis relative to arm 138. This pivoting motion allows the beam to be positioned substantially parallel to the surface being cleaned regardless of the angle at which the boom 124 approaches the surface. As a result, the beam will be oriented so as to suspend the machine as shown in FIG. 9.

In another embodiment, the apparatus of FIG. 7 can be supported on the fixture 101 as illustrated in FIGS. 4 and 5. In such an embodiment, the winch 85 is mounted on the end of support arm 113 rather than on apparatus 1. The operation of the device will proceed as in the preferred embodiment except that vertical movement of the apparatus will be provided by the winch mounted to fixture 101.

As the apparatus is raised, a vertical swath of surface 2 is cleaned that is as wide as the range of oscillation of blast machine 4. Once the apparatus reaches the top of surface 2, support 101 is moved around the tank or beam 116 is moved along the surface 2 by a boom arm, JLG or other support mechanism a distance equal to the width of the cleaned strip and the apparatus is lowered. This process is repeated until the entire surface is cleaned.

The support structure 48 can be separated from the blast unit 4 by simply lifting pulley wheels 58 and 60 from rail 56 to break the apparatus down to a size where it can fit through the small door in the storage tank. Additionally, the drive motors 7 and 42 and the screw conveyor 40 and the bar magnets 46 can also be removed from the unit to further reduce its size if desired. The device can be quickly and easily reassembled on the interior of the tank.

Figure 13:
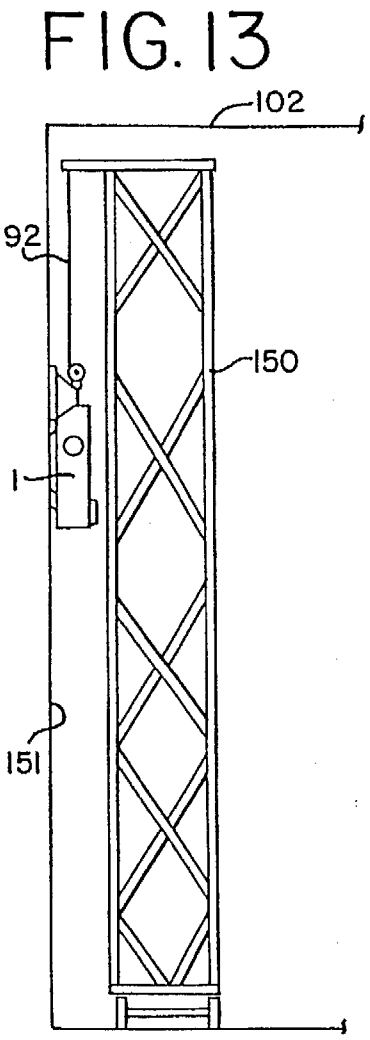
FIG. 13 is a side view showing the apparatus of the invention supported on a scaffold.
Figure 10:
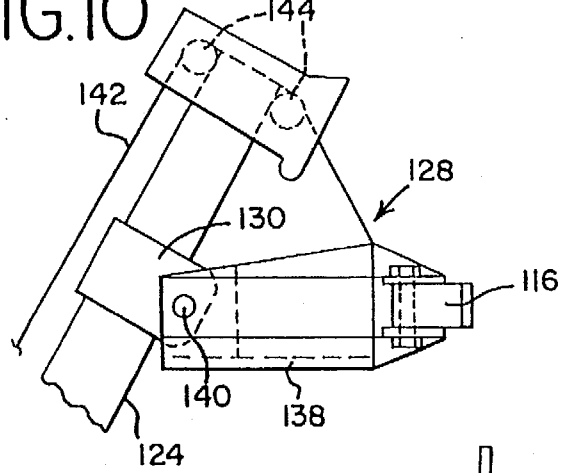
FIGS. 10, 11 and 12 are detailed views showing the support apparatus for use with a boom.
Figure 11:
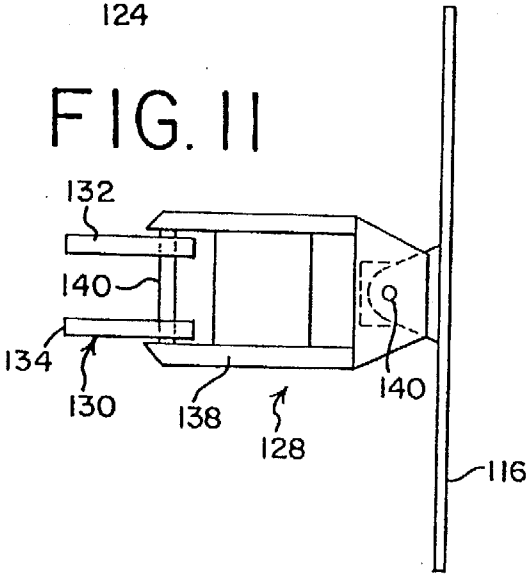
Figure 12:
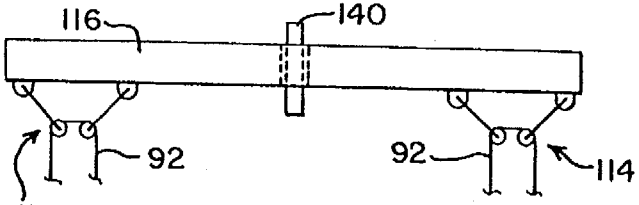

Referring to FIG. 13, to clean the interior of a storage tank, the cables 92 are suspended from the top of the scaffolding 150 that is presently used for hand cleaning the interior of the tank 102 such that the apparatus 1 rest against the inside wall 151. The interior surface can then be cleaned by simply moving the scaffolding around the interior of the tank. It should be noted that the scaffolding support arrangement can be used on the exterior of the ship or tank as well as on the interior of the tank, if desired.

It will be appreciated that the winch for moving the apparatus vertically can be mounted on the apparatus as shown in FIGS. 4 and 5, on the fixture as shown in FIGS. 7 and 8 or on the support at the top of the surface being cleaned (not shown). Moreover, with the winch located in any one of these positions, the apparatus can be supported by the support of FIGS. 4 and 5, the support beams of FIGS. 7 and 8, the boom truck or JLG of FIG. 9 or any other suitable support. Moreover, the support beams of FIGS. 7 and 8 could be used with the support of FIGS. 4 and 5, with the boom truck or JLG of FIG. 9 or with another support mechanism. Finally, the scaffolding shown in FIG. 13 can be used in place of the supports of FIGS. 4, 5, 7, 8 and 9 with the winch mounted to the scaffolding, the apparatus 1 or the cart 108. As will be appreciated, the support for the apparatus can have a variety of configurations provided it can move the apparatus vertically and horizontally over the surface. Moreover, carriage 40 could carry surface cleaning apparatuses other than the blast unit. For example, the blast unit could be replaced by scrubbing brushes or a painting unit if desired.

In the blast cleaning apparatus of the invention, the axis of rotation of the blast wheel 6 is arranged perpendicular to the direction of travel of the apparatus and parallel to the direction of oscillation. Such an orientation of the blast wheel in combination with the oscillating movement of the blast unit creates a sharp line of demarcation between the cleaned area of the surface and the uncleaned area. As a result, minimal overlap of adjacent passes of the blast unit is required and a more efficient cleaning process results. The blast cleaning apparatus of the invention due to the oscillation of the unit cleans a wide path of surface without leaving a fanning pattern. ("Fanning" in the blast cleaning industry is the cleaning pattern on a treated surface where the areas of surface ahead of and behind the blast wheel are not cleaned as thoroughly as the area directly below the blast wheel.) Thus, a surface treated with the oscillating blast machine of the invention is efficiently cleaned or treated uniformly over the entire surface.

While the invention has been described in some detail with respect to the drawings, it will be appreciated that numerous changes in the details and construction of the invention can be made without departing from the spirit and scope of the invention.

What is claimed is:

1. A blast cleaning apparatus, for cleaning a surface, comprising:

a) a blast unit for projecting abrasive cleaner towards the surface;

b) a housing for containing the blast unit;

c) a carriage for supporting the housing for movement on the surface in a vertical direction and including a rail for supporting the housing for traversing movement in a horizontal direction with respect to the carriage; and d) means for mounting the housing for movement along the rail such that a distal end of the housing remains suspended and free to rotate about the rail for permitting engagement of the blast unit with the surface; whereby the means for mounting permits the housing to be disengaged from the rail when the housing is lifted in a vertical direction.

2. The apparatus of claim 1, wherein the means for mounting includes at least one pulley wheel adapted to engage the rail.

3. The apparatus of claim 1, wherein the carriage further comprises a pair of vertically-oriented sleds for supporting the carriage for sliding engagement with the surface.

4. The apparatus of claim 3, wherein the sleds each include a strip of high molecular weight plastic.

5. The apparatus of claim 4, wherein the sleds further include permanent magnets for magnetically attracting the carriage to metal surfaces to prevent horizontal movement of the carriage.

6. The apparatus of claim 5, wherein the carriage includes means for disengaging the magnets from the surface.

7. The apparatus of claim 6, wherein the means for disengaging includes a reciprocating piston and a plunger attached thereof for engaging the surface.

8. The apparatus of claim 1, wherein the carriage includes a drive system for reciprocating the housing on the rail.

9. The apparatus of claim 8, wherein the drive system includes a cable attached to the housing and a fluid cylinder mounted on the carriage for driving the cable in reciprocal fashion.

* * * * *